US008978257B2

(12) United States Patent
Quimby et al.

(10) Patent No.: US 8,978,257 B2
(45) Date of Patent: Mar. 17, 2015

(54) UTILITY KNIFE WITH A BLADE HAVING MULTIPLE CUTTING PORTIONS

(71) Applicants: Elwood Dean Quimby, Derby, KS (US); Hubert J. Bung, Wichita, KS (US); Jeremy E. Weinman, Derby, KS (US)

(72) Inventors: Elwood Dean Quimby, Derby, KS (US); Hubert J. Bung, Wichita, KS (US); Jeremy E. Weinman, Derby, KS (US)

( * ) Notice: Subject to any disclaimer, the term of this patent is extended or adjusted under 35 U.S.C. 154(b) by 0 days.

(21) Appl. No.: 14/018,113

(22) Filed: Sep. 4, 2013

(65) Prior Publication Data

US 2014/0068951 A1 Mar. 13, 2014

Related U.S. Application Data

(63) Continuation-in-part of application No. 13/199,206, filed on Aug. 23, 2011, now abandoned.

(60) Provisional application No. 61/743,426, filed on Sep. 4, 2012, provisional application No. 61/402,536, filed on Sep. 1, 2010.

(51) Int. Cl.

| | |
|---|---|
| ***B26B 5/00*** | (2006.01) |
| ***B26B 9/00*** | (2006.01) |
| ***B25G 1/08*** | (2006.01) |

(52) U.S. Cl.

CPC . *B26B 5/006* (2013.01); *B26B 9/00* (2013.01); *B25G 1/08* (2013.01); *B26B 5/00* (2013.01)

USPC ..... 30/329; 30/330; 30/331

(58) Field of Classification Search

CPC ..... B26B 3/00; B26B 5/00; B26B 5/002; B26B 9/00; B26B 9/02; B25G 3/12; B25G 3/20

USPC ..... 30/329–331, 337–340, 342

See application file for complete search history.

(56) References Cited

U.S. PATENT DOCUMENTS

| | | | | | |
|---|---|---|---|---|---|
| 59,770 | A | | 11/1866 | Jann | |
| 394,349 | A | | 12/1888 | Elliot | |
| 639,850 | A | | 12/1899 | Hahn | |
| 670,120 | A | | 3/1901 | Van Tuyl | |
| 834,022 | A | * | 10/1906 | Phillips | 30/331 |
| 870,425 | A | * | 11/1907 | Frazier | 30/330 |
| 978,165 | A | | 12/1910 | Johnson | |
| 1,081,357 | A | * | 12/1913 | Woodworth | 30/339 |

(Continued)

FOREIGN PATENT DOCUMENTS

| | | |
|---|---|---|
| FR | 2571486 | 4/1986 |
| FR | 2629578 | 10/1989 |

(Continued)

*Primary Examiner* — Jason Daniel Prone

(74) *Attorney, Agent, or Firm* — Law Office of Mark Brown, LLC; Christopher M. DeBacker; Mark E. Brown

(57) ABSTRACT

A utility knife employing a blade having multiple cutting portions, and a housing for quickly and simply swapping out one cutting portion for another. In a preferred embodiment, a six-cutting-portion featured blade is employed. Each point of the six-cutting-portion featured blade features two distinct cutting portions, for a total of six cutting portions located on a single blade. The blade can be rotated about a central axis to expose new cutting portions as old portions wear and dull. In another embodiment, a single-edged blade featuring two cutting faces is housed in a knife handle. The blade can be flipped when the first portion is dull or worn to expose a second cutting face. The handle may optionally include a storage space for storing additional blades.

5 Claims, 22 Drawing Sheets

(56) References Cited

U.S. PATENT DOCUMENTS

| | | | | | |
|---|---|---|---|---|---|
| D47,697 | S | | 8/1915 | Korpa | |
| D47,778 | S | | 8/1915 | Yapczenski | |
| 1,176,257 | A | | 3/1916 | Velcansky | |
| 1,261,815 | A | * | 4/1918 | Housdorfer | 30/337 |
| 1,278,682 | A | | 9/1918 | Kohnz | |
| 1,477,721 | A | * | 12/1923 | Shee | 30/331 |
| 1,600,126 | A | | 9/1926 | Myatt | |
| 1,726,017 | A | * | 8/1929 | Enfants, Sr. | 30/339 |
| 1,739,214 | A | | 12/1929 | Darling | |
| 1,814,528 | A | | 7/1931 | Purcell | |
| 1,829,499 | A | | 10/1931 | Boos | |
| 1,850,090 | A | | 3/1932 | Alexander et al. | |
| 1,872,721 | A | | 8/1932 | Ford | |
| 1,903,789 | A | | 4/1933 | Michaels | |
| 1,940,107 | A | | 12/1933 | Stichler | |
| 2,003,761 | A | | 6/1935 | Testi | |
| 2,027,964 | A | * | 1/1936 | Delbon | 30/331 |
| 2,036,057 | A | | 3/1936 | Kulisek | |
| 2,041,778 | A | | 5/1936 | Peters | |
| 2,070,190 | A | | 2/1937 | Wells | |
| 2,126,080 | A | | 8/1938 | Backer | |
| 2,248,796 | A | | 7/1941 | Vosbikian et al. | |
| 2,270,970 | A | * | 1/1942 | Schaftel | 30/339 |
| 2,272,805 | A | * | 2/1942 | Jaasund et al. | 30/339 |
| 2,324,555 | A | | 7/1943 | Blunk | |
| 2,326,502 | A | * | 8/1943 | Sieg | 30/338 |
| 2,365,301 | A | | 12/1944 | Shortell | |
| 2,382,440 | A | | 8/1945 | Peterson | |
| 2,443,873 | A | | 6/1948 | Simpson | |
| 2,464,206 | A | * | 3/1949 | Becker | 30/339 |
| 2,520,463 | A | | 8/1950 | Hubner | |
| 2,542,582 | A | | 2/1951 | Schwork | |
| 2,551,899 | A | | 5/1951 | Pfeifer et al. | |
| 2,557,539 | A | | 6/1951 | Dawson | |
| 2,587,336 | A | | 2/1952 | Larson | |
| 2,599,193 | A | * | 6/1952 | Morris | 30/339 |
| 2,631,372 | A | | 3/1953 | Fournier | |
| 2,637,105 | A | * | 5/1953 | Forst | 30/330 |
| 2,650,442 | A | | 9/1953 | Soltow et al. | |
| 2,662,287 | A | | 12/1953 | Ferguson | |
| 2,681,506 | A | | 6/1954 | Tipple | |
| 2,732,620 | A | | 1/1956 | Gibbs | |
| 2,835,031 | A | | 5/1958 | Cook et al. | |
| 2,863,213 | A | | 12/1958 | Rypysc | |
| 2,962,816 | A | | 12/1960 | Glotzer | |
| 3,037,342 | A | | 6/1962 | Boyer | |
| 3,045,348 | A | | 7/1962 | Dungan | |
| 3,377,703 | A | * | 4/1968 | Longobardi | 30/330 |
| 3,448,518 | A | | 6/1969 | Sklar | |
| 3,518,758 | A | | 7/1970 | Bennet | |
| 3,600,729 | A | | 8/1971 | Laughlin et al. | |
| 3,641,667 | A | | 2/1972 | Leopoldi | |
| 3,802,077 | A | * | 4/1974 | Averitt | 30/339 |
| 3,872,591 | A | | 3/1975 | Quenot | |
| 3,900,950 | A | * | 8/1975 | Collins | 30/337 |
| 3,965,575 | A | * | 6/1976 | Stunger | 30/330 |
| 4,027,389 | A | | 6/1977 | Atchisson | |
| 4,077,124 | A | | 3/1978 | Christmann | |
| 4,288,921 | A | | 9/1981 | Rhynes | |
| 4,292,738 | A | * | 10/1981 | Osada | 30/339 |
| 4,502,219 | A | | 3/1985 | Hibben | |
| 4,504,091 | A | | 3/1985 | Ohshiro | |
| 4,534,110 | A | | 8/1985 | Glass | |
| 4,592,113 | A | | 6/1986 | Selfors | |
| 4,606,125 | A | | 8/1986 | Jensen | |
| 4,730,394 | A | | 3/1988 | Sonner | |
| 4,745,653 | A | | 5/1988 | Bliznak | |
| 4,787,146 | A | | 11/1988 | Gaskins | |
| 4,807,362 | A | | 2/1989 | Prentice | |
| 4,856,385 | A | | 8/1989 | Ogilvie et al. | |
| 4,886,009 | A | | 12/1989 | Gondar et al. | |
| 5,003,696 | A | | 4/1991 | Spehar | |
| 5,056,226 | A | * | 10/1991 | Gringer | 30/339 |
| 5,081,770 | A | | 1/1992 | Fierthaler | |
| 5,103,564 | A | | 4/1992 | MacDonald | |
| 5,146,685 | A | * | 9/1992 | Doucette | 30/330 |
| 5,303,474 | A | | 4/1994 | Keklak et al. | |
| 5,303,574 | A | | 4/1994 | Matossian et al. | |
| 5,349,753 | A | | 9/1994 | Gaffney | |
| 5,400,512 | A | | 3/1995 | Brush | |
| RE34,979 | E | * | 6/1995 | Gringer | 30/339 |
| 5,440,811 | A | | 8/1995 | Challis | |
| 5,446,965 | A | | 9/1995 | Makridis | |
| 5,528,832 | A | * | 6/1996 | Schmidt | 30/337 |
| 5,557,852 | A | | 9/1996 | Frisina | |
| 5,636,845 | A | | 6/1997 | Newham | |
| 5,720,105 | A | | 2/1998 | Gates | |
| 5,722,168 | A | * | 3/1998 | Huang | 30/339 |
| 5,769,094 | A | | 6/1998 | Jenkins, Jr. et al. | |
| D400,412 | S | | 11/1998 | Gold | |
| 5,960,545 | A | | 10/1999 | Shepherd et al. | |
| 5,966,816 | A | * | 10/1999 | Roberson | 30/156 |
| 6,134,788 | A | | 10/2000 | Chen et al. | |
| 6,163,965 | A | | 12/2000 | Lung | |
| 6,192,589 | B1 | | 2/2001 | Martone et al. | |
| 6,243,952 | B1 | | 6/2001 | Holcomb et al. | |
| 6,314,646 | B1 | | 11/2001 | Schmidt | |
| 6,321,454 | B1 | | 11/2001 | Wass | |
| D462,250 | S | | 9/2002 | Ping | |
| 6,446,341 | B1 | | 9/2002 | Wang et al. | |
| 6,454,427 | B1 | | 9/2002 | Chen | |
| 6,460,254 | B1 | | 10/2002 | Mori et al. | |
| 6,497,045 | B1 | | 12/2002 | Forgami | |
| 6,711,824 | B2 | | 3/2004 | Hruska | |
| 6,796,033 | B2 | | 9/2004 | Owoc | |
| 6,823,593 | B2 | | 11/2004 | Dunn-Rankin | |
| 6,848,185 | B2 | | 2/2005 | Tebo | |
| 6,854,187 | B2 | * | 2/2005 | Huan | 30/339 |
| 6,887,250 | B1 | | 5/2005 | Dority et al. | |
| 6,895,674 | B2 | | 5/2005 | Ai | |
| D510,009 | S | | 9/2005 | Lee | |
| 6,968,622 | B2 | | 11/2005 | Ping | |
| 6,976,311 | B2 | | 12/2005 | Lee | |
| 7,093,367 | B1 | | 8/2006 | Huang | |
| 7,255,705 | B2 | | 8/2007 | Hsu et al. | |
| 7,380,341 | B2 | | 6/2008 | Ping | |
| D580,241 | S | | 11/2008 | Fraga et al. | |
| 7,480,997 | B2 | | 1/2009 | Ping | |
| 7,552,537 | B2 | | 6/2009 | Ye | |
| 7,565,747 | B2 | * | 7/2009 | Cobb et al. | 30/329 |
| D602,752 | S | | 10/2009 | Luciano et al. | |
| D617,161 | S | | 6/2010 | Tom et al. | |
| D617,162 | S | | 6/2010 | Tom et al. | |
| D619,865 | S | | 7/2010 | Boehler | |
| 7,797,835 | B2 | | 9/2010 | Zeng | |
| 7,900,363 | B1 | * | 3/2011 | White | 30/340 |
| 7,921,568 | B2 | | 4/2011 | Green | |
| 8,006,389 | B2 | * | 8/2011 | Jennings et al. | 30/330 |
| 8,006,391 | B1 | | 8/2011 | Mashburn et al. | |
| 8,056,241 | B2 | | 11/2011 | Davis et al. | |
| 8,074,362 | B2 | | 12/2011 | Gui et al. | |
| 8,291,601 | B2 | * | 10/2012 | Kehr et al. | 30/329 |
| 8,356,415 | B2 | * | 1/2013 | Lin | 30/338 |
| 8,381,407 | B1 | * | 2/2013 | White | 30/340 |
| D686,481 | S | | 7/2013 | Robinson et al. | |
| 8,549,754 | B2 | * | 10/2013 | Bung et al. | 30/340 |
| 8,567,069 | B2 | | 10/2013 | Robinson et al. | |
| 8,739,412 | B2 | | 6/2014 | Gioia | |
| 8,776,380 | B1 | | 7/2014 | Quimby et al. | |
| 2003/0177645 | A1 | | 9/2003 | Flury et al. | |
| 2003/0200853 | A1 | | 10/2003 | Gongola | |
| 2004/0010920 | A1 | * | 1/2004 | DeLillo | 30/337 |
| 2004/0055165 | A1 | | 3/2004 | Chan | |
| 2004/0103541 | A1 | | 6/2004 | Scarla | |
| 2004/0231169 | A1 | | 11/2004 | Roberson | |
| 2005/0223567 | A1 | * | 10/2005 | Cobb et al. | 30/339 |
| 2006/0117570 | A1 | * | 6/2006 | Pool | 30/162 |
| 2006/0272157 | A1 | | 12/2006 | Zeng | |
| 2007/0256310 | A1 | * | 11/2007 | Pool et al. | 30/339 |
| 2008/0264227 | A1 | | 10/2008 | Sudmalis et al. | |
| 2009/0165309 | A1 | | 7/2009 | Kamb et al. | |
| 2009/0211421 | A1 | | 8/2009 | Lier et al. | |
| 2010/0175267 | A1 | | 7/2010 | Seber et al. | |
| 2010/0299935 | A1 | | 12/2010 | Ping | |

(56) References Cited

U.S. PATENT DOCUMENTS

| | | | | |
|---|---|---|---|---|
| 2011/0167647 | A1 | 7/2011 | Gringer et al. | |
| 2012/0055029 | A1 | 3/2012 | Gui et al. | |
| 2012/0079722 | A1* | 4/2012 | Quimby et al. | 30/353 |
| 2012/0240413 | A1 | 9/2012 | Quimby et al. | |
| 2013/0047447 | A1 | 2/2013 | Fossella | |
| 2013/0185943 | A1 | 7/2013 | Landwehr | |
| 2013/0333230 | A1* | 12/2013 | Quimby et al. | 30/321 |
| 2014/0068951 | A1 | 3/2014 | Quimby et al. | |
| 2014/0182144 | A1* | 7/2014 | Quimby et al. | 30/351 |
| 2014/0208594 | A1 | 7/2014 | Scimone et al. | |
| 2014/0259686 | A1 | 9/2014 | Garavaglia et al. | |
| 2014/0304993 | A1* | 10/2014 | Rafii | 30/330 |

FOREIGN PATENT DOCUMENTS

| | | |
|---|---|---|
| FR | 2634874 | 2/1990 |
| FR | 2682062 | 4/1993 |

* cited by examiner

UTILITY KNIFE WITH A BLADE HAVING MULTIPLE CUTTING PORTIONS

CROSS-REFERENCES TO RELATED APPLICATIONS

This application claims priority in U.S. Provisional Patent Application No. 61/743,426 filed on Sep. 4, 2012, and is a continuation-in-part of and claims priority in U.S. patent application Ser. No. 13/199,206, filed Aug. 23, 2011, which claims priority in U.S. Provisional Patent Application No. 61/402,536, filed Sep. 1, 2010, all of which are incorporated herein by reference.

BACKGROUND OF THE INVENTION

1. Field of the Invention

This application relates to utility knife blades, and more particularly, to unconventional utility knife blades with six defined individual cutting portions that allow the user to have available on one blade, six individual cutting portions that will be used with special designed utility knives.

2. Background and Description of the Related Art

Conventional disposable utility blades are well known in the art. These blades, along with their knives, have many industrial as well as home uses, such as for opening boxes, cutting cord or cutting wallboard. Typical utility blades are encased in a plastic or metal handle in either a fixed or retractable position. When in use, the blade is positioned to extend outwardly from the handle, exposing the cutting edge and one of the cutting points of the blade.

Utility knife blades come in a variety of shapes depending upon the intended use. A conventional utility blade has a generally trapezoidal shape that includes a back edge, a cutting edge and two side edges. The trapezoidal shaped blades have two cutting portions or tips formed at the intersections between the side edges and the cutting edge. These sharp points or tips enable a user to puncture through a material which is desired to be cut, such as sealing tape or the cardboard box. Once the object has been punctured and penetrated, the user can slice open the material by dragging the knife along the surface of the material allowing the cutting edge to cut through the material.

Existing prior art includes U.S. Pat. Nos. 7,921,568; 5,557,852; 2,542,582; 4,592,113; 3,037,342; 5,636,845; and 4,745,653.

Although trapezoidal-shaped utility blades are widely used, they have only two usable cutting portions. They have the disadvantage that when the two edges get dull, the blade has to be replaced. The two-edged blade, therefore, requires more frequent replacement after the two cutting edges are worn out.

Break-off style blades with a multitude of cutting portions are not well suited for many applications and there is a greater safety or injury risk due to potential snap-off during usage when side loads are applied.

There is a need for an improved utility knife blade that overcomes one or more of the above-described drawbacks and/or disadvantages of conventional prior art utility knife blades.

SUMMARY OF THE INVENTION

The present invention provides a utility knife employing a blade having multiple cutting portions, and a means for quickly and simply swapping out one cutting edge portion for another.

In a preferred embodiment, six-cutting-portion featured blade is employed. Each point of the generally triangular-shaped, six-cutting-portion featured blade features two distinct cutting portions, for a total of six cutting portions located on a single blade. The blade can be rotated about a central axis to expose new cutting edges portions as old portions wear and dull.

In another embodiment, a standard, trapezoidal-shaped, single-edged blade featuring two cutting faces is housed in a knife handle. The blade can be flipped when the first edge is dull or worn to expose a second cutting face. The handle may optionally include a storage space for storing additional blades.

One embodiment of the present invention features a knife handle capable of holding a blade with multiple cutting portions, such that the blade can be turned or flipped to present a new cutting portion when the previous cutting portion has become dull.

Another embodiment features the same handle, but includes a storage space within the handle for storing additional blades.

Another embodiment features a hinged flap which bolts against the handle, thereby making it even simpler to install, flip, or exchange blades.

Another embodiment features a hinged flap and also a number of support pegs which provide additional support for the blade and may be used in situations where higher pressure is applied to the blade during the cutting process. The pegs may be removable or permanently attached to the handle.

Another embodiment features a pivoting arm connected to a similar such hinged flap, wherein the arm may be locked in a lowered position, thereby securing the blade to the handle, or the arm may be raised, thereby releasing the blade.

A knife blade storage compartment which is capable of storing new and used knife blades may optionally be included with any variant of the knife, the knife storage compartment further improving the features of the overall knife.

Other aspects and advantages of the present invention will become more readily apparent in view of the following detailed description and accompanying drawings.

DETAILED DESCRIPTION OF THE PREFERRED EMBODIMENTS

I. Introduction and Environment

As required, detailed aspects of the disclosed subject matter are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, base, front, back, right and left refer to the invention as oriented in the view being referred to. The words "inwardly" and "outwardly" refer to directions toward and away from, respectively, the geometric center of the embodiment being described and designated parts thereof. Forwardly and rearwardly are generally in reference to the direction of travel, if appropriate. Said terminology will include the words specifically mentioned, derivatives thereof and words of similar meaning.

A preferred embodiment features a knife blade body capable of allowing a knife blade to rotate or turn, thereby exposing additional cutting surfaces for use.

II. Preferred Embodiment Utility Knife Apparatus 2

Figure 1:
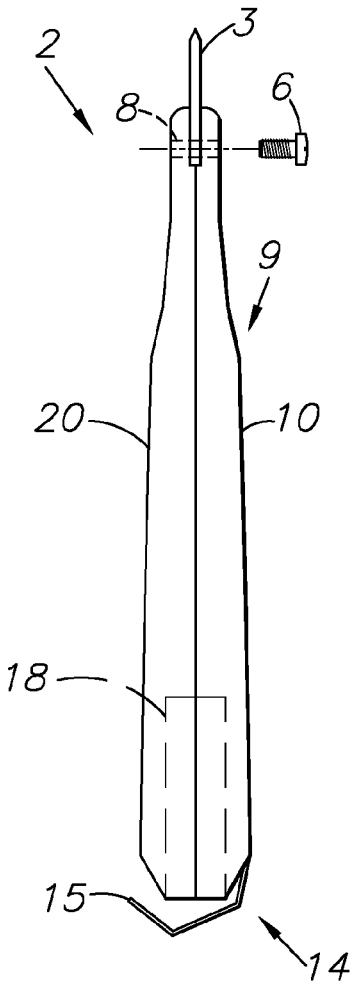
FIG. 1 is a front elevational view of a knife embodying an aspect of the present invention.
Figure 2:
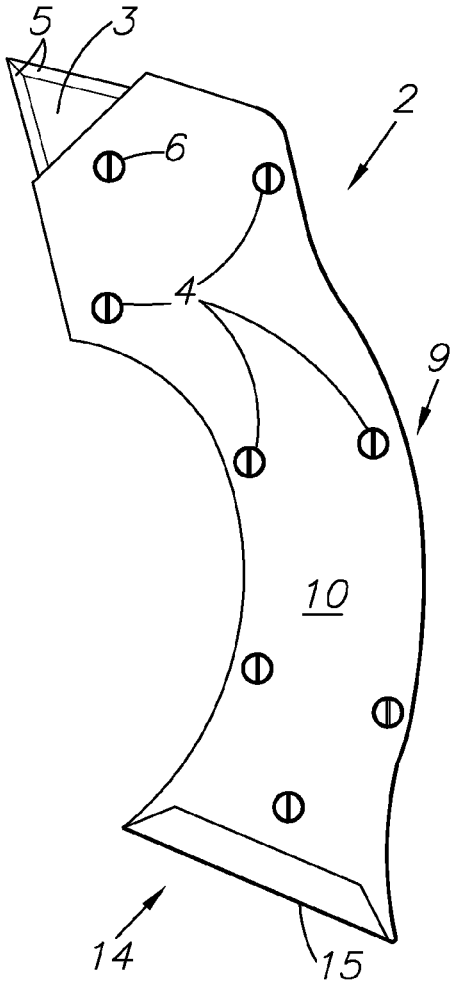
FIG. 2 is a side elevational view thereof.
Figure 3:
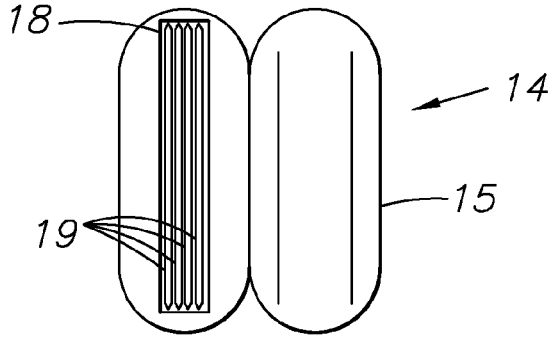
FIG. 3 is a bottom plan view thereof.

As shown in FIGS. 1-3, a preferred embodiment of the present invention includes a knife handle 9 comprising a right portion 10 and a left portion 20, a six-cutting-portion featured knife blade 3, and a blade mounting bolt 6 for mounting the blade 3 between the right 10 and left 20 portions of the handle 9. The blade mounting bolt 6 is inserted through an opening 8 through the handle 9 and the blade 3 itself. A number of securing or mounting bolts 4 are used to join the handle together.

This embodiment includes a storage space 18 located in the base portion 14 of the handle 9 for storing additional multiedged cutting blades 19. A simple covering 15 keeps the extra blades 19 within the storage space 18 until they are needed. The covering 15 could simply clamp over or otherwise snap on to the base portion 14 of the handle 9, or it may include a hinged end which allows the covering to swing away from the base, thereby exposing the extra blades. Other options could also be used, such as providing a simple cap which plugs the opening to the storage space 18 by the covering 15.

Figure 20A:
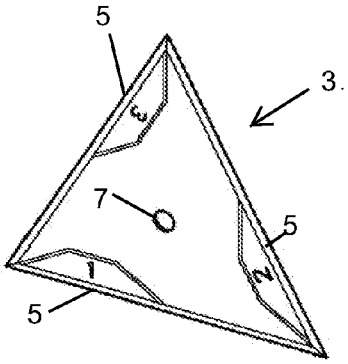
FIG. 20A is an isometric view of a three-sided blade.
Figure 20B:
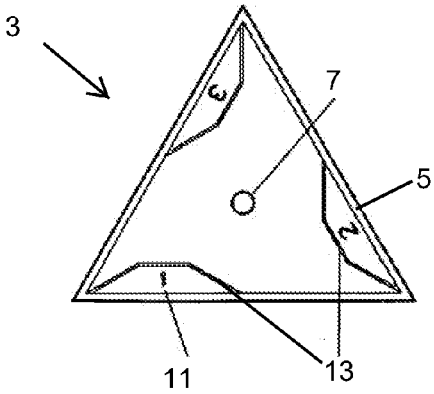
FIG. 20B is a front elevational view thereof.
Figure 20C:
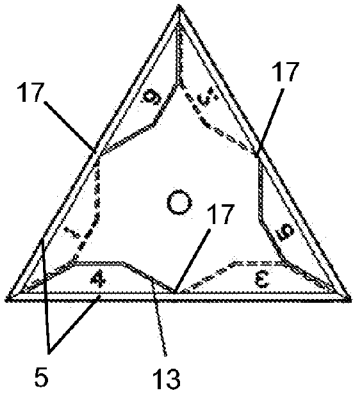
FIG. 20C is a rear elevational view thereof, showing the blade edges located on the front face in hidden lines.
Figure 20D:
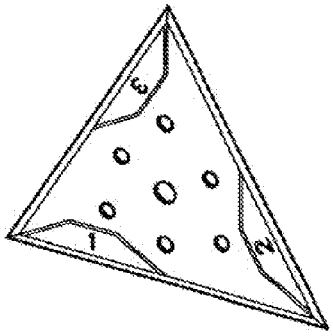
FIG. 20D is an isometric view of a three-sided blade of an alternative configuration.
Figure 20E:
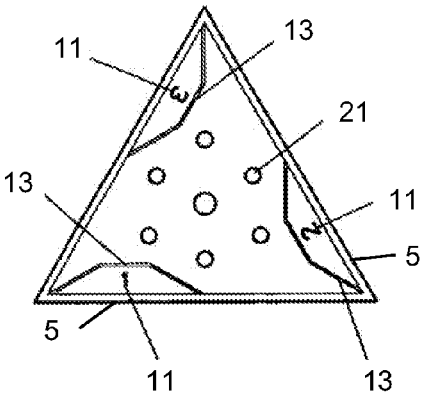
FIG. 20E is a front elevational view thereof.
Figure 20F:
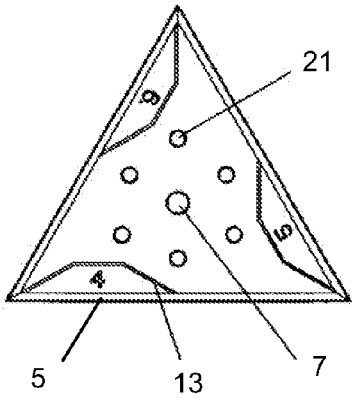
FIG. 20F is a rear elevational view thereof.
Figure 20G:
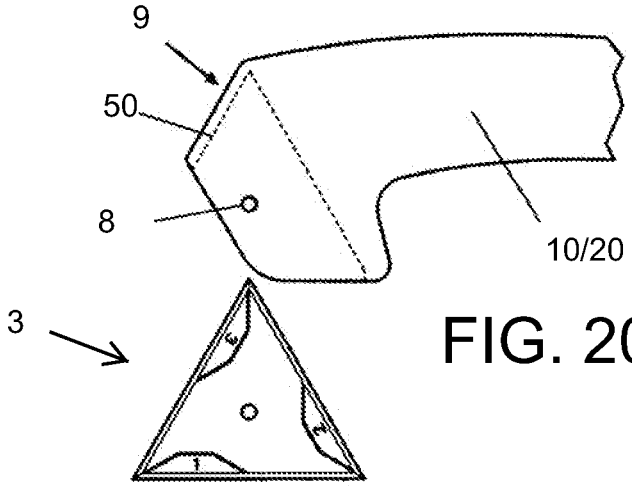
FIG. 20G is a side elevational view of a three-sided blade being fitted into a simplified knife handle and blade receiver head.
Figure 20H:
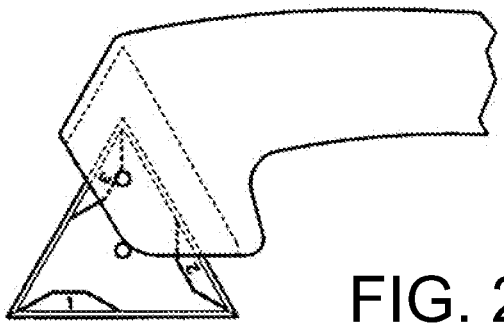
FIG. 20H is a second step in a series thereof.
Figure 20I:
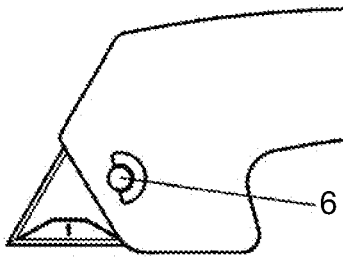
FIG. 20I is a third step in a series thereof.
Figure 20J:
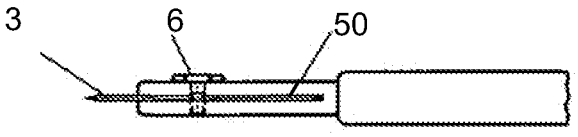
FIG. 20J is a top plan view thereof.
Figure 20K:
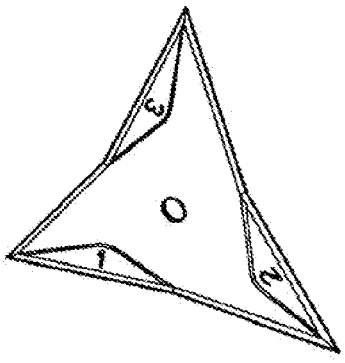
FIG. 20K is an isometric view of a three-sided blade of an alternative configuration.
Figure 20L:
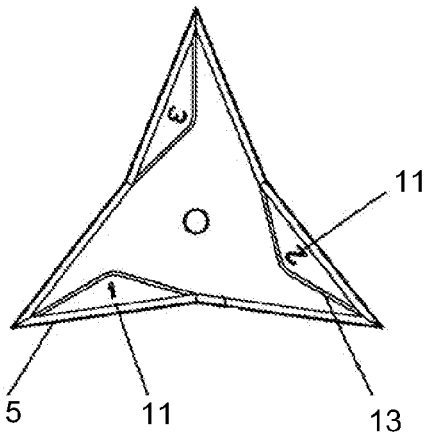
FIG. 20L is a front elevational view thereof.
Figure 20M:
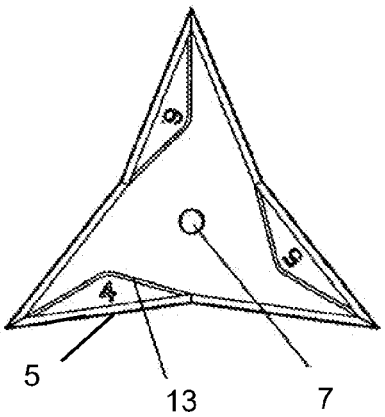
FIG. 20M is a rear elevational view thereof.

FIGS. 20A-20M provide more detail on how the three-sided blade plays a role in the preferred embodiment of the present invention. FIGS. 20A-C show how the knife blade previously described presents six cutting portions, and how each portion can be presented from the knife handle by flipping or turning the blade within the blade retaining head. Each cutting portion is labeled by an edge a portion label 11. A blade cutting portion indicator 13 distinguishes the cutting portion from the body of the blade. FIG. 20C shows the gap 17 located between two separate cutting portions 5. The gap can be a flat space, a notch, or it could be a continuous cutting edge. The purpose of the gap 17 is to designate between two separate cutting portions. FIGS. 20D-F show an alternative arrangement of the three-sided blade which includes a secondary ring of mounting holes 21 which provides additional stability to a blade secured by those holes in addition to the blade retaining hole 7. FIGS. 20G-J show how the cutting portion labeled "1" is presented initially when the blade is received by a blade receiving space 50 located within the handle 9 halves 10, 20. FIGS. 20K-M provide even more options for how the cutting portions of the three-sided blade may be presented.

FIGS. 4-9D present a blade storage compartment 22 which optionally may be mounted to a wall or otherwise stored with or near the knife apparatus 2. The storage compartment 22 primarily comprises a storage body 26 with a pair of slots 25 adapted for inserting into a receiver 46 located on a wall mount 24 which is mounted to a wall or other structure by inserting nails, screws, or similar elements through mounting holes 44 located on the wall mount 24. The storage body 26 also includes a number of insert receivers 40 for receiving the insert tabs 38 of an upper plate 28. The upper plate keeps blades 3 stored safely with the confines of the storage body 26. The upper plate also includes a thumb slot 36 which allows a user to use their thumb to grip and press against the top of a stored blade for removal or storage purposes.

Figure 4:
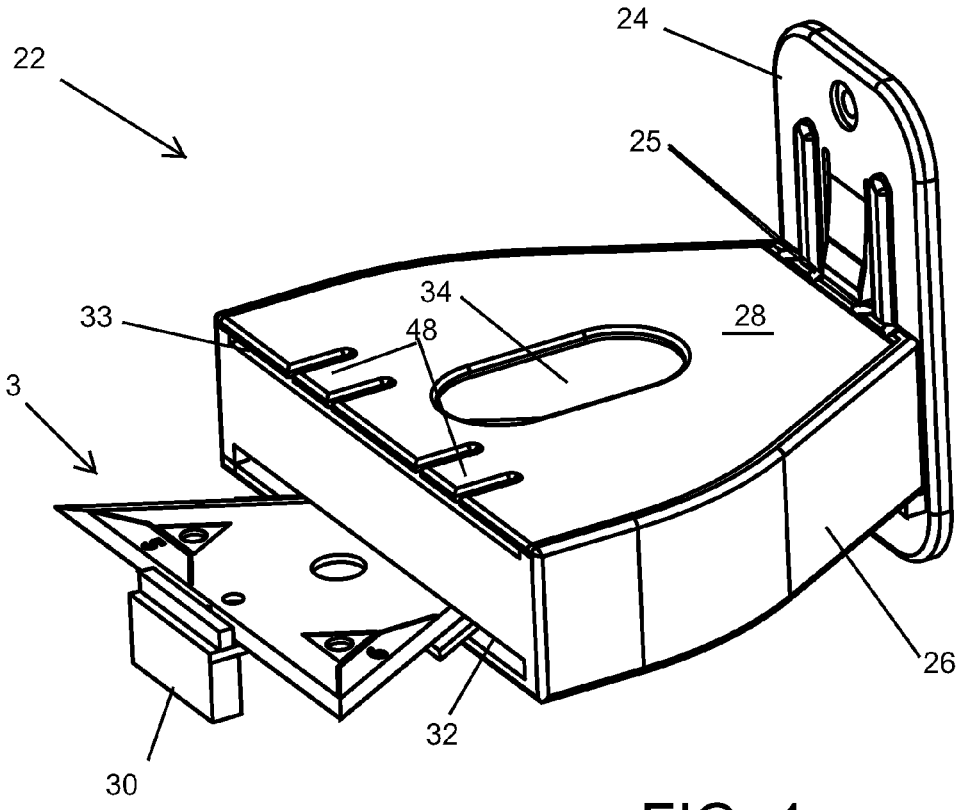
FIG. 4 is an isometric view of a blade storage compartment embodying an aspect of the present invention.
Figure 5:
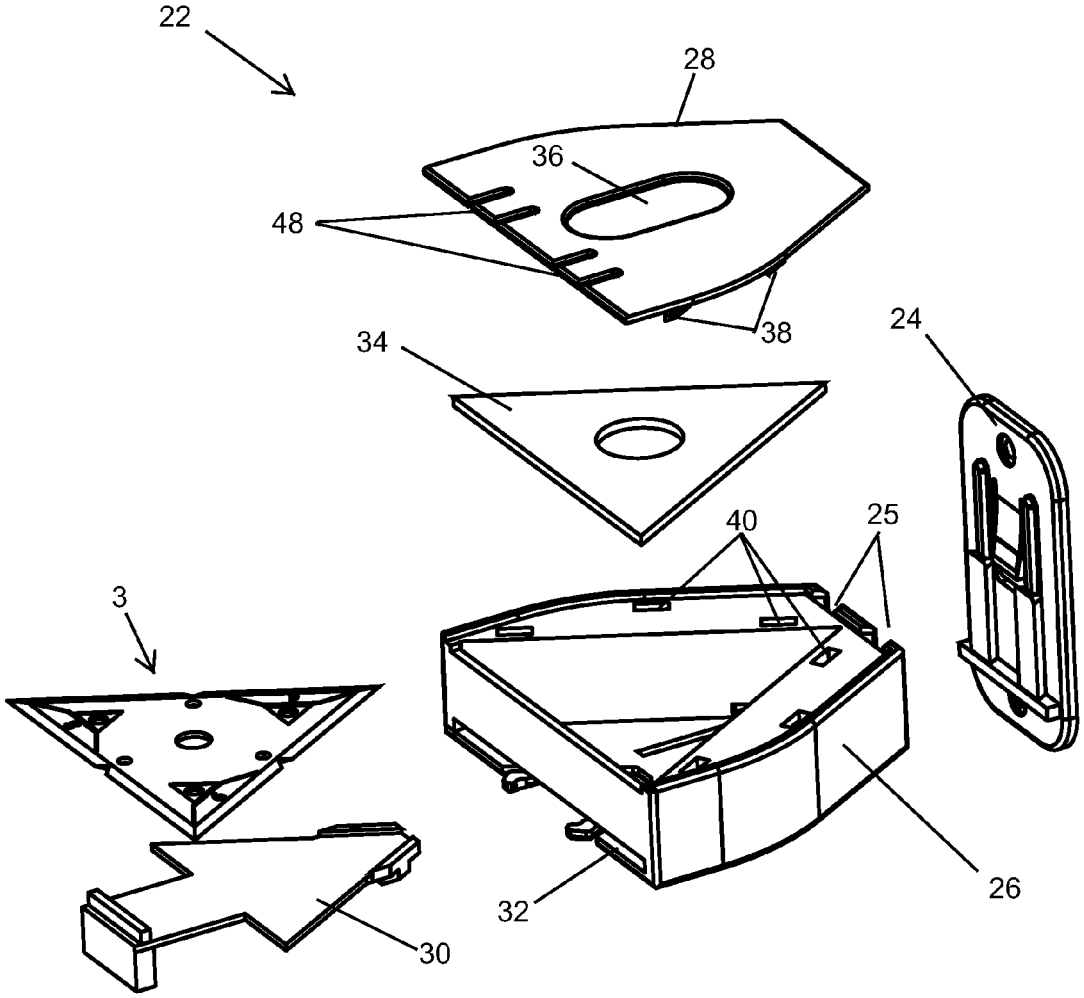
FIG. 5 is an exploded isometric view thereof.
Figure 6A:
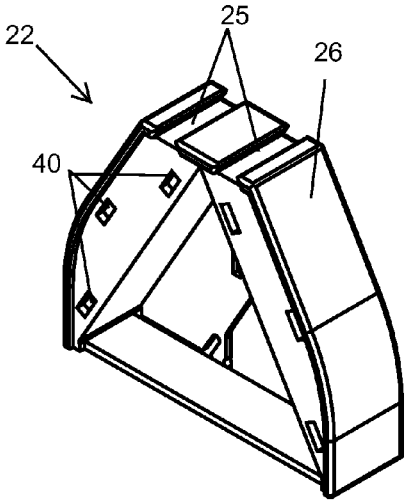
FIG. 6A is an alternative isometric view thereof.
Figure 6B:
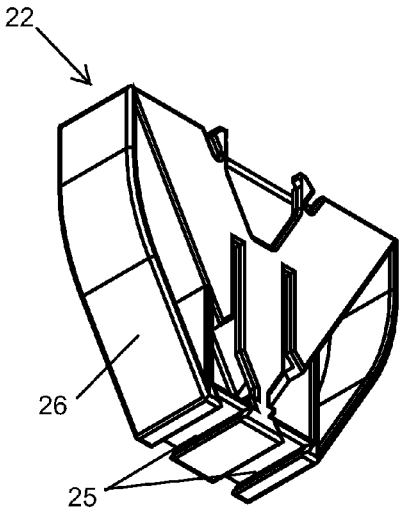
FIG. 6B is an alternative isometric view thereof.
Figure 6C:
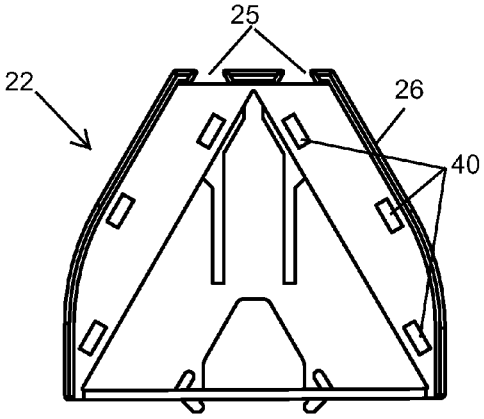
FIG. 6C is a top plan view thereof.
Figure 6D:
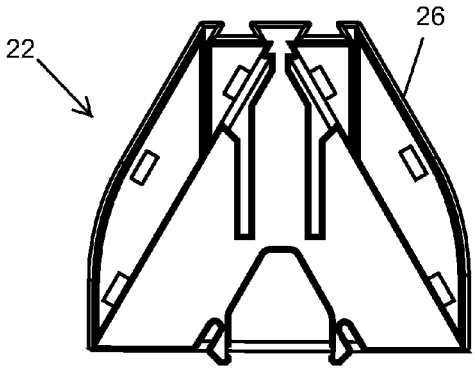
FIG. 6D is a bottom plan view thereof.
Figure 7A:
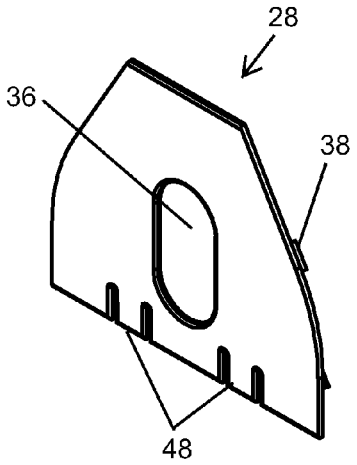
FIG. 7A is an isometric view of a top plate element of the blade storage compartment.
Figure 7B:
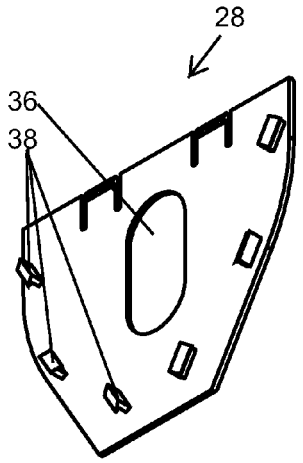
FIG. 7B is an alternative isometric view thereof.
Figure 7C:
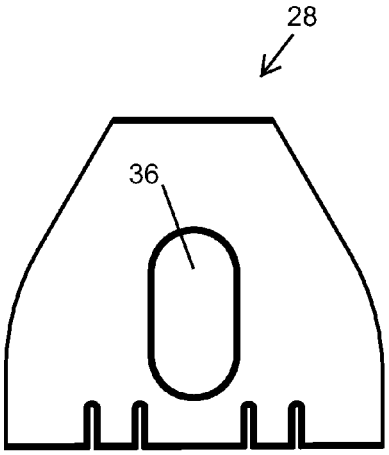
FIG. 7C is a top plan view thereof.
Figure 7D:
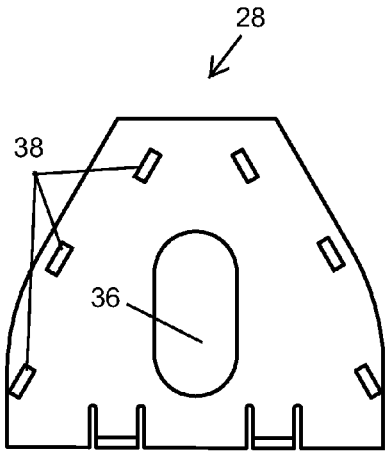
FIG. 7D is a bottom plan view thereof.
Figure 8A:
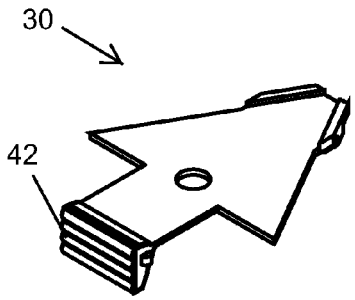
FIG. 8A is an isometric view of a blade tray element of the blade storage compartment.
Figure 8B:
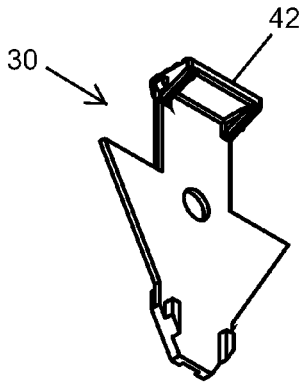
FIG. 8B is an alternative isometric view thereof.
Figure 8C:
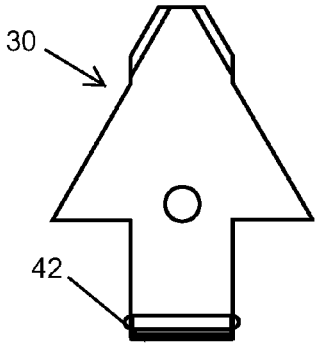
FIG. 8C is a top plan view thereof.
Figure 8D:
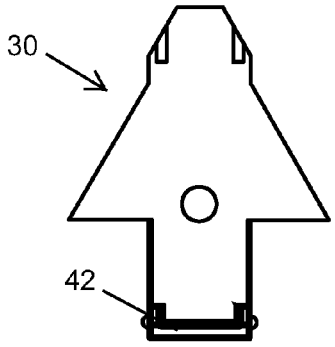
FIG. 8D is a bottom plan view thereof.
Figure 9A:
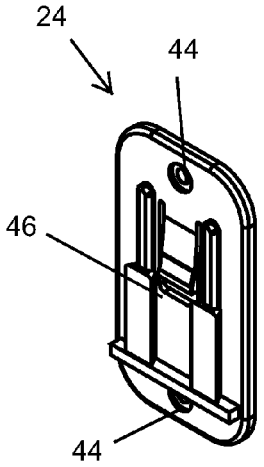
FIG. 9A is an isometric view of an optional wall mount element of the blade storage compartment.
Figure 9B:
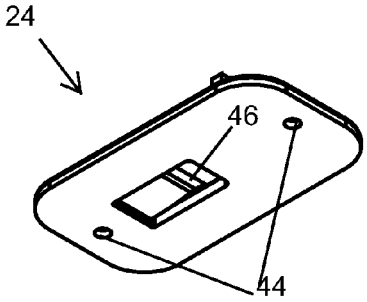
FIG. 9B is an alternative isometric view thereof.
Figure 9C:
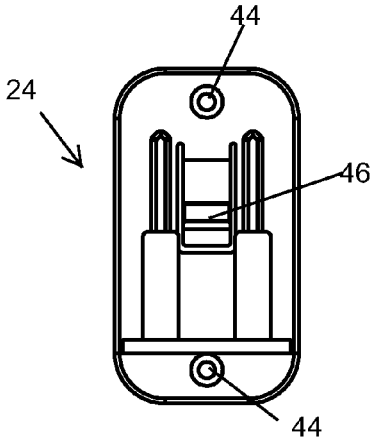
FIG. 9C is a top plan view thereof.
Figure 9D:
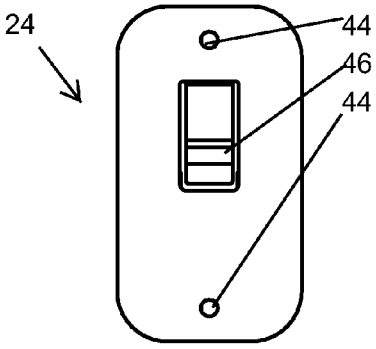
FIG. 9D is a bottom plan view thereof.

A spacer 34 can be used to segregate new, sharp blades from old, dull blades, but both blade types may be stored within the same container 22. A blade tray 30 with a pressure knob 42 assists a user in inserting or removing new blades 3 from the lower blade slot 32 of the storage body 26. As shown in FIG. 4, the blade tray slides partially out from the storage body to allow the user to refill the storage container or to remove a blade for use. The pressure knob 42 locks into place against the upper lip of the blade slot 32 until the user puts pressure against the pressure knob 42, thereby releasing the tray 30 such that a blade may be withdrawn from the storage compartment 22.

Old, dull, or otherwise used blades may be inserted into the storage container through an upper slot 33. These blades remain separated from the new blade by the spacer 34. A pair of flexible taps 48 prevent old blades from sliding back out through the slot 33. Each tap has a raised catch lip, which allows a blade to be pushed into the slot past the catch, but which prevents the blade from sliding back out.

It should be noted that a similar configuration using a trapezoidal-shaped, standard razor blade could be supplemented for the six-cutting-edge blades shown in the figures.

III. Alternative Embodiment Utility Knife Apparatus 52

Figure 10:
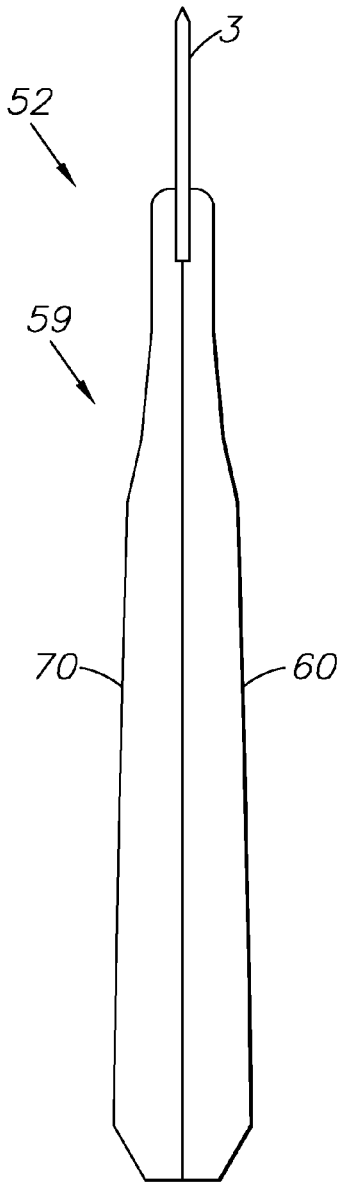
FIG. 10 is a front elevational view of an alternative embodiment knife embodying an aspect of the present invention.
Figure 11:
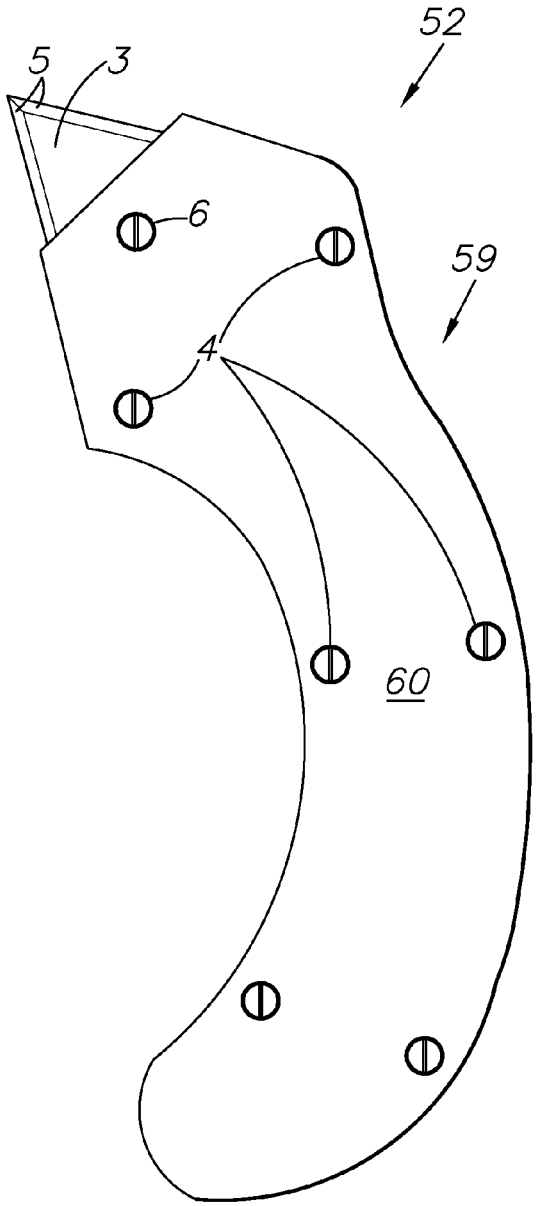
FIG. 11 is a side elevational view thereof.

As shown in FIGS. 10 and 11, an alternative embodiment of the present invention includes a knife handle 59 comprising a right portion 60 and a left portion 70. This knife apparatus 52 is functionally identical to the previous embodiment; however, no storage department is contained within the handle for storing additional blades.

IV. Second Alternative Embodiment Utility Knife Apparatus 102

Figure 12:
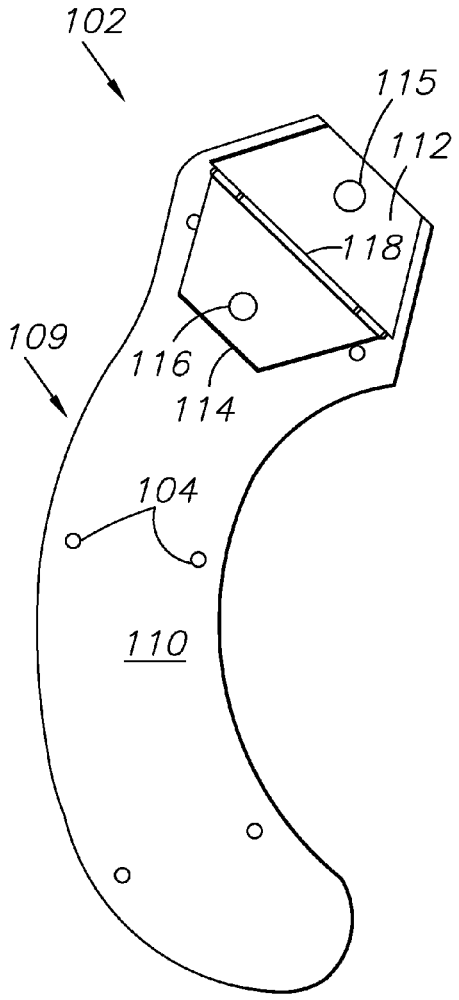
FIG. 12 is a side elevational view of an alternative embodiment knife embodying an aspect of the present invention, showing the handle in an open position without a blade.
Figure 13:
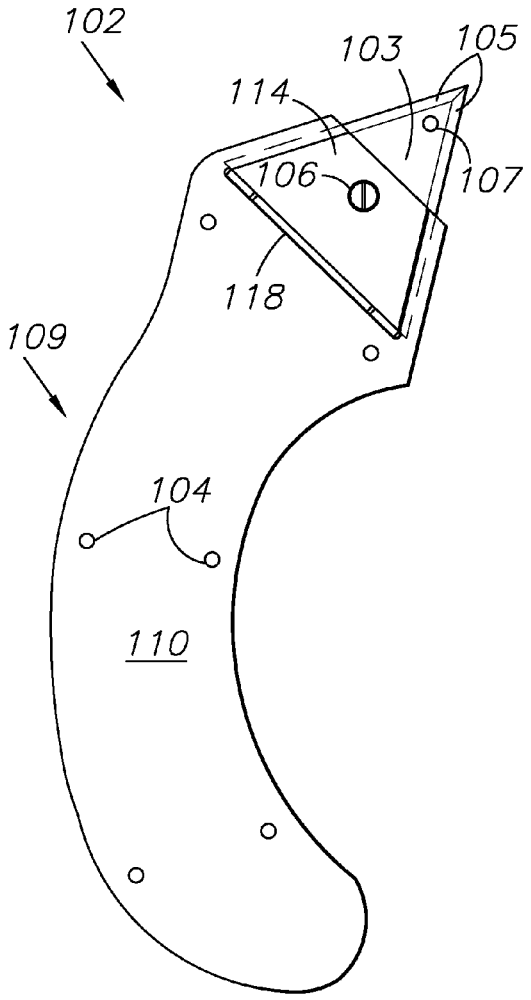
FIG. 13 is a side elevational view of thereof, showing the handle in a closed position with a blade secured.

As shown in FIGS. 12 and 13, an alternative knife handle 109 having a right half 110 and a left half (not shown) is presented, where the handle is held together by a number of handle mounting bolts 104. The handle 109 encloses an alternative blade 103 having multiple cutting portions 105, and which blade contains a number of additional mounting holes 107. The previously disclosed blade 3 may also be used in this embodiment.

The blade 103 is inserted into a space 112 located in the handle. A panel 114 connected to the handle by a hinge 118 is used to secure the blade in place for cutting operations. When the panel 114 is closed and the mounting bolt 106 is inserted through the panel bolt hole 116, the blade, and the handle bolt hole 115, the blade is securely locked in place and can be used to cut. When the user wishes to change cutting portions or entire blades, the mounting bolt 106 is removed, the panel 114 is opened, and the blade is rotated or removed.

V. Third Alternative Embodiment Utility Knife Apparatus 152

Figure 14:
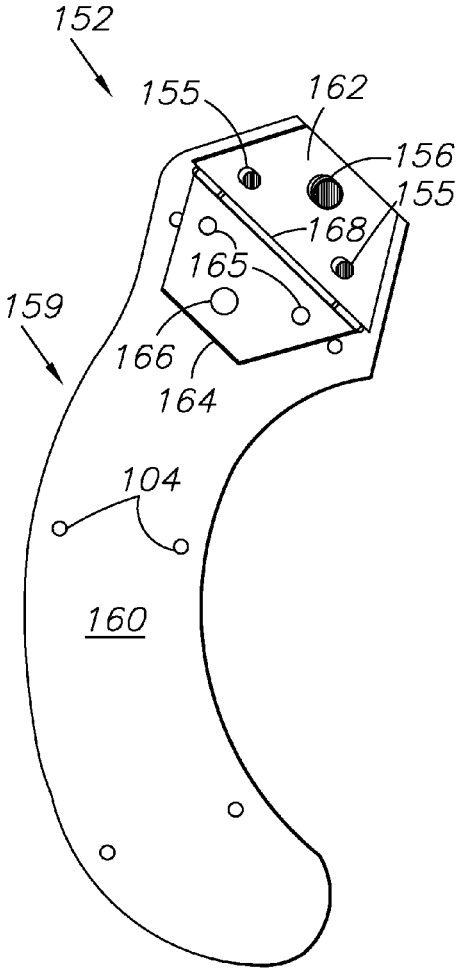
FIG. 14 is a side elevational view of an alternative embodiment knife embodying an aspect of the present invention, showing the handle in an open position without a blade.
Figure 15:
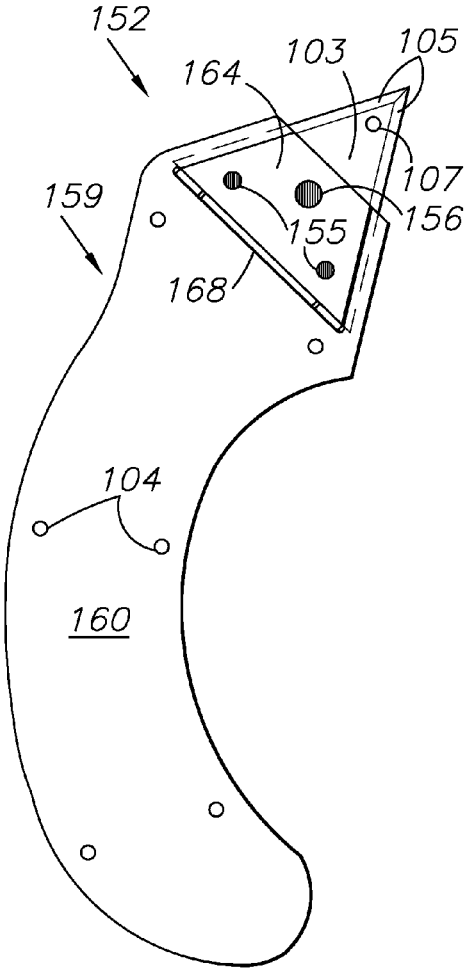
FIG. 15 is a side elevational view of thereof, showing the handle in a closed position with a blade secured.

As shown in FIGS. 14 and 15, and similar to the previous embodiment, an alternative knife handle 159 having a right half 160 and a left half (not shown) is presented, where the handle is held together by a number of handle mounting bolts 104. The handle 159 encloses an alternative blade 103 having multiple cutting portions 105, and which blade contains a number of additional mounting holes 107. The blade 103 is inserted into a space 162 located in the handle. A panel 164 connected to the handle by a hinge 168 is used to secure the blade in place for cutting operations.

A pair of pegs 155 is located within the blade mounting space 162, and these pegs are inserted into the additional mounting holes 107 of the blade. Similarly, the panel 164 includes a pair of peg receiving spaces or holes 165 for securing the pegs. The pegs 155 may be permanently affixed to the handle or may be temporary and replaceable. As in the previous embodiment, when the panel 164 is closed and the mounting bolt 156 is inserted through the panel bolt hole 166, the blade, and the handle bolt hole (not shown), the blade is securely locked in place and can be used to cut. When the user wishes to change cutting portions or entire blades, the mounting bolt 156 is removed, the panel 164 is opened, and the blade is rotated or removed. This combination, including the supporting pegs 155, allows a blade to be used for higher-pressure cutting scenarios.

Figure 15A:
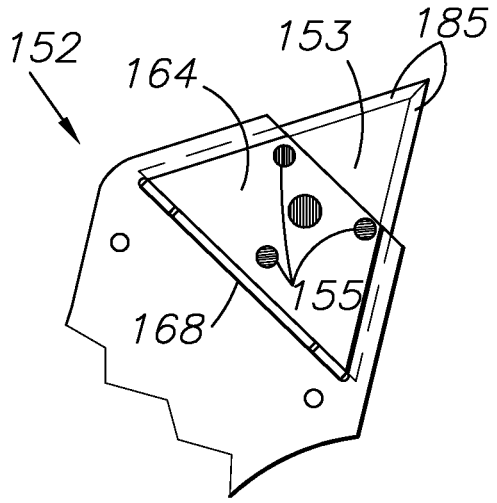
FIG. 15A is a partial side elevational view thereof, showing an alternative arrangement of the elements and featuring an alternative blade.
Figure 15B:
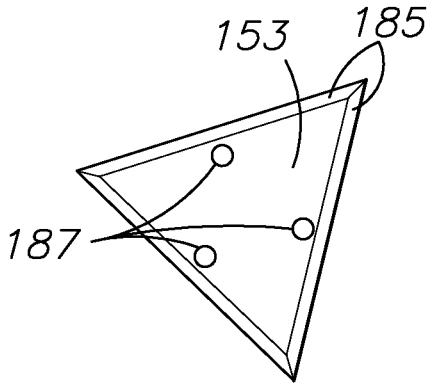
FIG. 15B is a side elevational view of the alternative blade thereof.

FIGS. 15A-B show an alternative blade 153 wherein the mounting holes 187 are located in between cutting portions 185, rather than toward the points as shown in previous figures. FIG. 15A shows an alternative arrangement of the securing pegs 155. This arrangement allows the mounting holes 187 to be fully concealed by the panel 164 when it is closed.

Figure 15C:
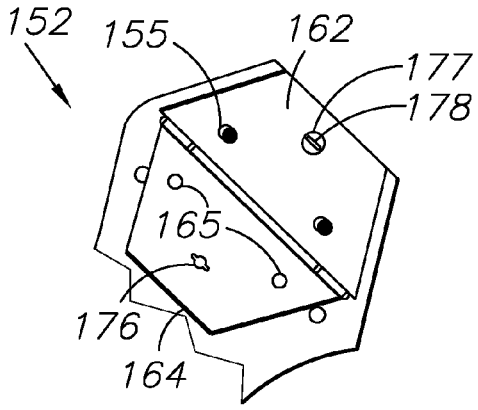
FIG. 15C is another partial side elevational view of the embodiment of FIG. 15, showing an alternative panel and handle construction for use with an alternative blade.
Figure 15D:
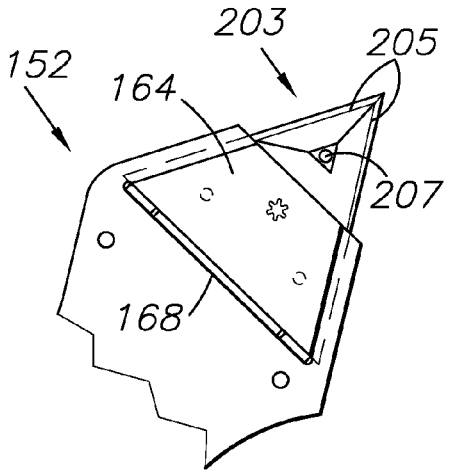
FIG. 15D is a partial side elevational view thereof, with the blade inserted into the handle.
Figure 15E:
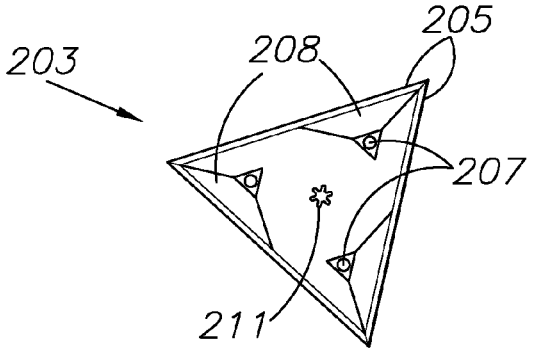
FIG. 15E is a side elevational view of the alternative blade thereof.
Figure 16A:
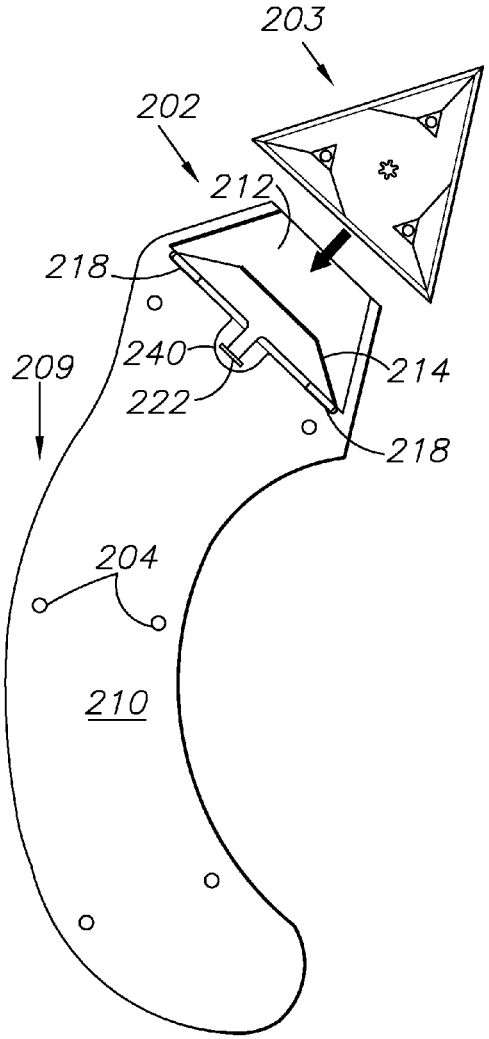
FIG. 16A is a right side elevational view of an alternative embodiment knife embodying an aspect of the present invention, showing the handle in an open position without a blade.
Figure 16B:
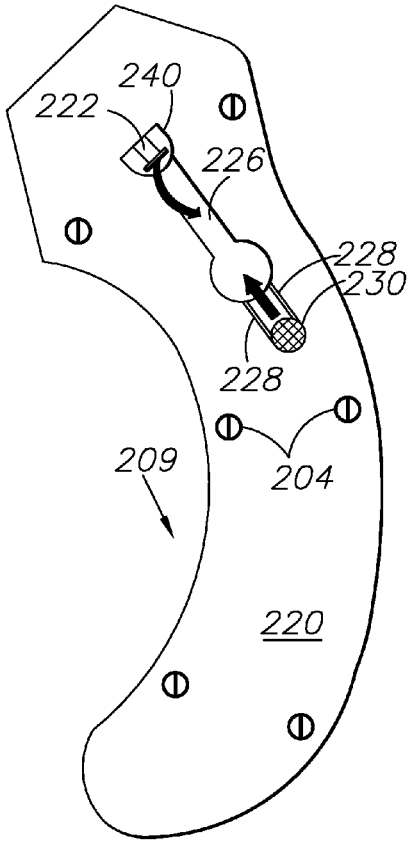
FIG. 16B is a left side elevational view thereof.
Figure 16C:
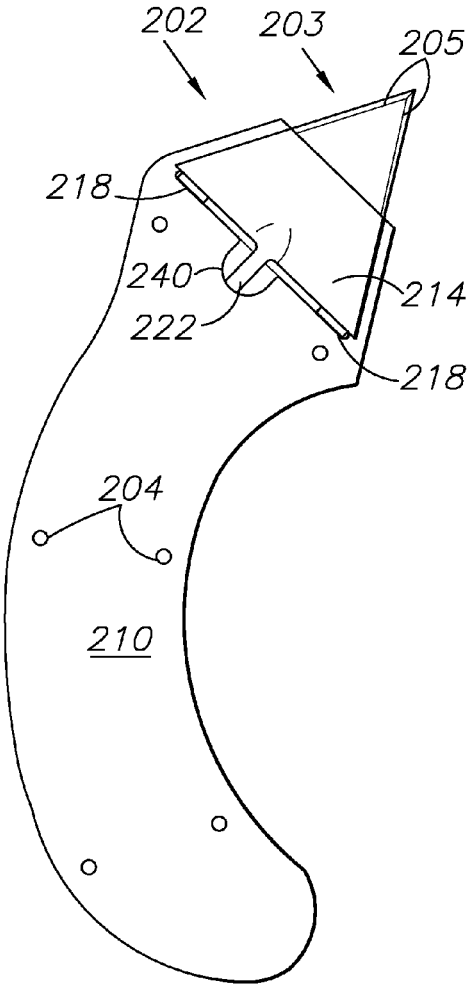
FIG. 16C is a right side elevational view thereof, with the handle in a closed position with a blade contained therein.
Figure 16D:
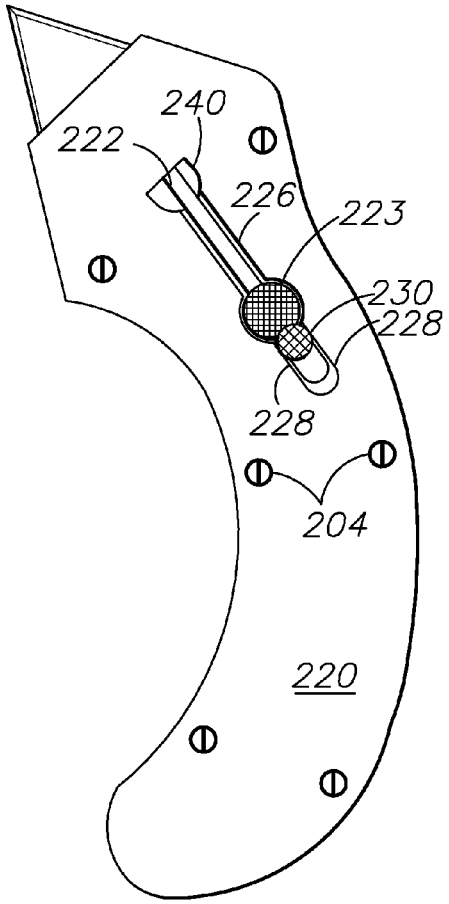
FIG. 16D is a left side elevational view thereof.
Figure 17A:
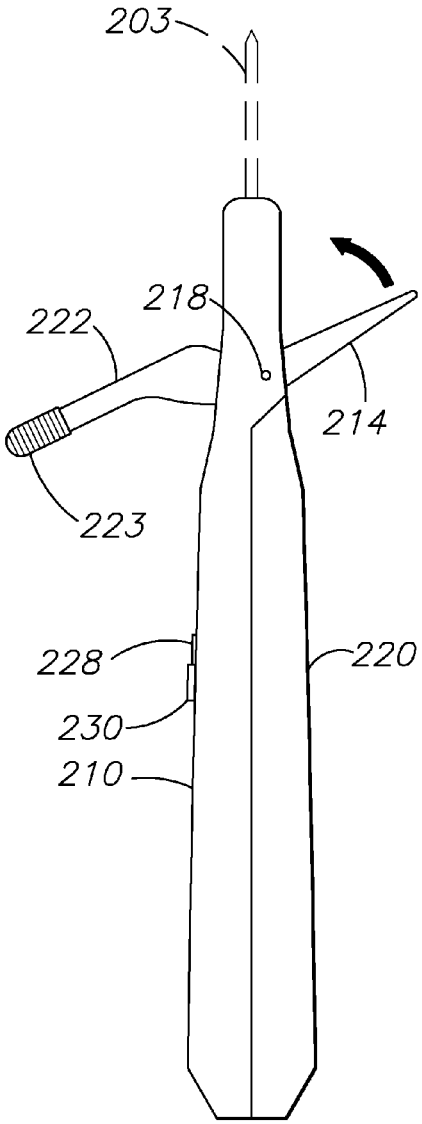
FIG. 17A is a front elevational view of thereof.
Figure 17B:
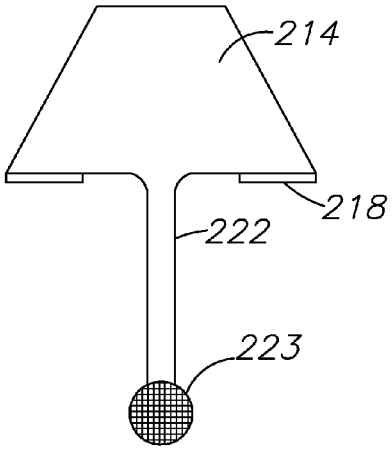
FIG. 17B is a side elevational view of a panel employed in the embodiment of FIGS. 16A-17A.
Figure 17C:
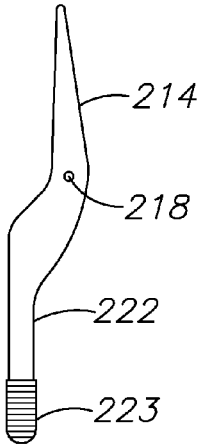
FIG. 17C is a front elevational view thereof.

FIGS. 15C-E show yet another alternative blade 203 featuring cutting portions 205 which are identified on the blade by cutting portion IDs 208. The IDs typically are numbers indicating the order in which the cutting portions should be utilized (e.g. 1, 2, 3, 4, 5, and 6). The mounting holes 207 are located above the ID. The central mounting hole 211 features a hole adapted for receiving a quarter-turn fastener or other similar mounting device. A recess 177 located in the mounting space 162 includes a locking element 178. This locking element passes through the central mounting hole 211 of the blade and locks into a receiver 176 located in the panel 164. FIG. 19A, discussed below, provides an example of how such a device could work.

VI. Fourth Alternative Embodiment Utility Knife Apparatus 202

As shown in FIGS. 16A-17C, a knife handle 209 having a right half 210 and a left half 220 is presented, where the handle is held together by a number of handle mounting bolts 204. The handle 209 encloses a blade 203 having multiple cutting portions 205. The blade 203 is inserted into a space 212 located in the handle. A panel 214 connected to the handle by a pivot point 218 is used to secure the blade in place for cutting operations. A lever 222 with a tip 223 adapted for gripping is connected to the panel 214, and operates to pivot the panel about the pivot point 218. An opening 240 allows the handle to pass through the body of the handle 209.

The lever 222 may be pivoted into a lever recess 226 located in the left handle portion 220. A sliding lock 230 located on rails 228 can be slid into place to engage the lever 222, thereby locking the lever against the body of the handle 209 within the lever recess 226. In this position the panel 214 will be in a closed position, thereby securing the blade 203 within the blade recess 212 of the handle. The blade can then be used to cut along the exposed cutting edge portion. Sliding the lock 230 back along the rails 228 allows the lever to pivot freely, thereby releasing the blade.

VII. Fifth Alternative Embodiment Utility Knife Apparatus 252

Figure 18:
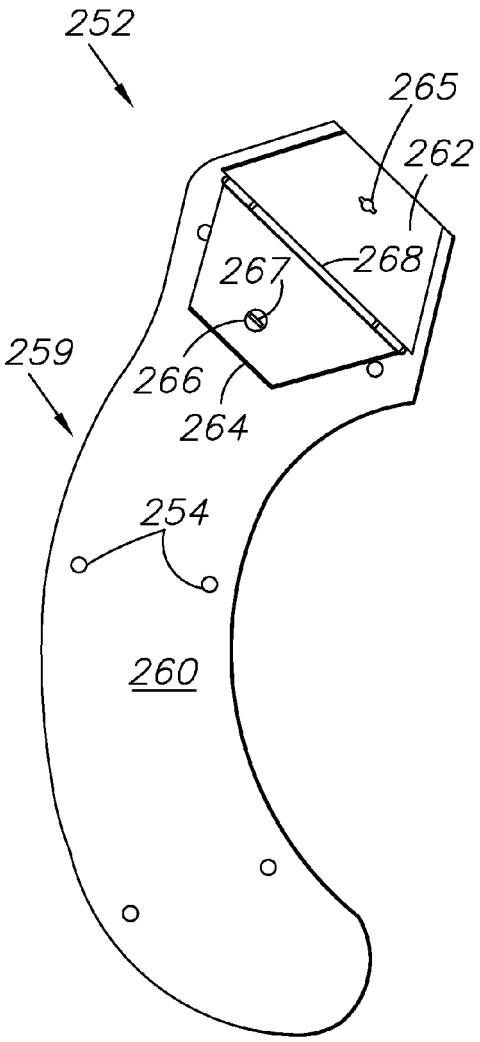
FIG. 18 is a side elevational view of another alternative embodiment knife embodying an aspect of the present invention, showing the handle in an open position without a blade.
Figure 19:
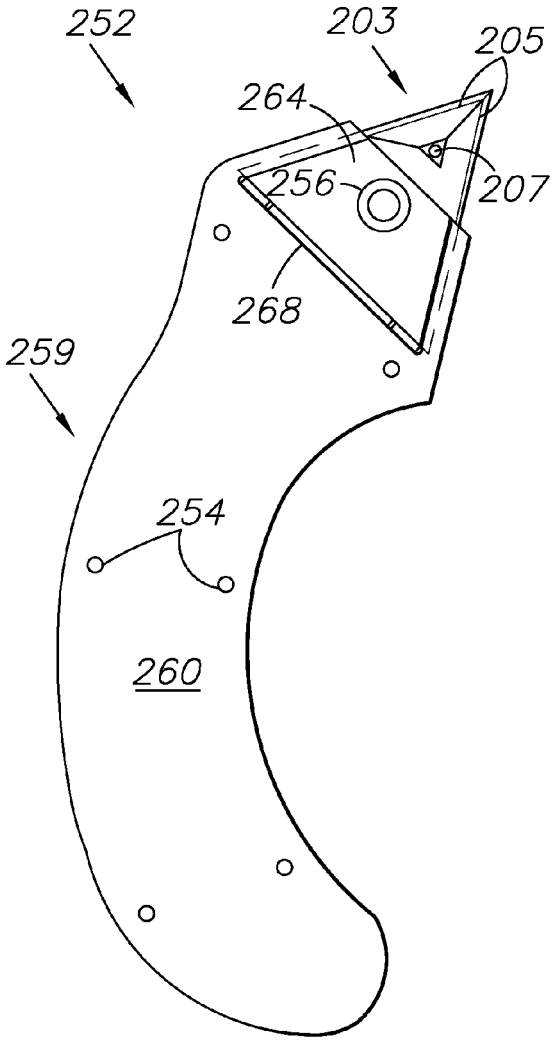
FIG. 19 is a side elevational view thereof, showing the handle in a closed position with a blade secured.
Figure 19A:
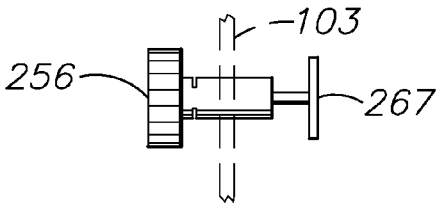
FIG. 19A is a side elevational view of a quarter-turn fastener element employed therein shown in relation to a blade.

As shown in FIGS. 18 and 19, and similar to previous embodiments, an alternative knife handle 259 having a right half 260 and a left half (not shown) is presented, where the handle is held together by a number of handle mounting bolts 254. The handle 259 encloses a blade 103 having multiple cutting portions 105, and which blade may optionally contain a number of additional mounting holes 107. The blade 103 is inserted into a space 262 located in the handle. A panel 264 connected to the handle by a hinge 268 is used to secure the blade in place for cutting operations.

A quarter-turn fastener 256 is used to secure the blade to the handle. The fastener 256 includes a locking element 267 located within a recess 266 on the internal face of the panel 264. A locking element receiver 265 located within the blade-mounting space 262 receives the locking element once the panel has been closed. A user would press against the fastener 256, thereby pressing the locking element 267 out of the recess 266, though the center hole of the blade 103, and into the receiver 265. The fastener 256 is then turned a quarter turn, thereby rotating the locking element 90 degrees within the receiver, locking the panel in place.

FIG. 19A is a side view of such a fastener in relation to the blade as it would sit within the receiving space 262.

Figure 21A:
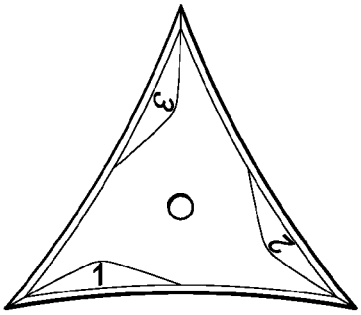
FIG. 21A is an elevational view of an alternative blade.
Figure 21B:
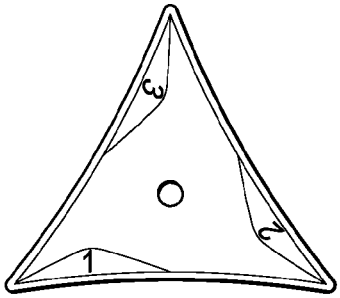
FIG. 21B is an elevational view of another alternative blade.
Figure 21C:
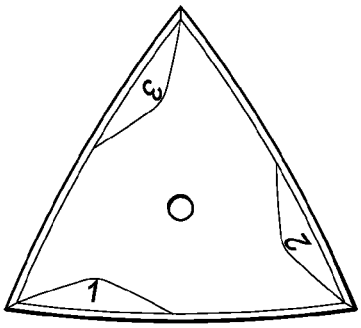
FIG. 21C is an elevational view of yet another alternative blade.
Figure 21D:
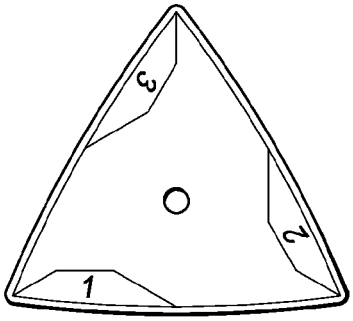
FIG. 21D is an elevational view of yet another alternative blade.
Figure 21E:
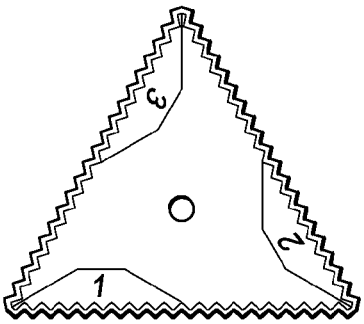
FIG. 21E is an elevational view of yet another alternative blade.
Figure 21F:
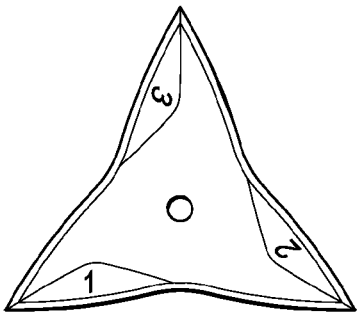
FIG. 21F is an elevational view of yet another alternative blade.
Figure 21G:
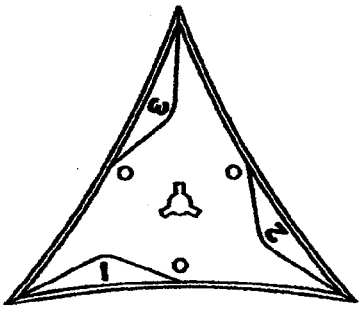
FIG. 21G is an elevational view of yet another alternative blade.
Figure 21H:
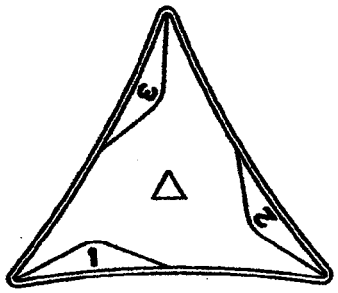
FIG. 21H is an elevational view of yet another alternative blade.
Figure 21I:
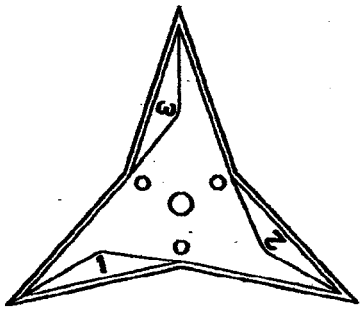
FIG. 21I is an elevational view of yet another alternative blade.
Figure 21J:
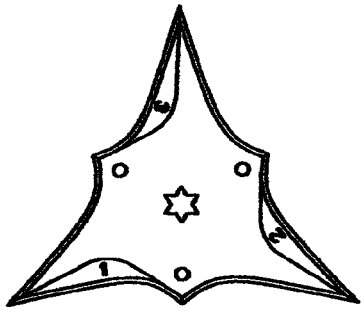
FIG. 21J is an elevational view of yet another alternative blade.
Figure 21K:
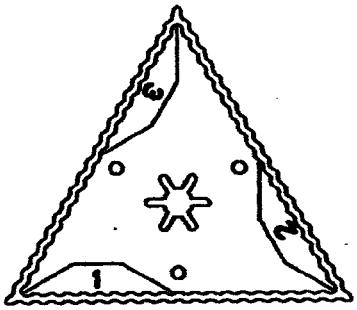
FIG. 21K is an elevational view of yet another alternative blade.
Figure 21L:
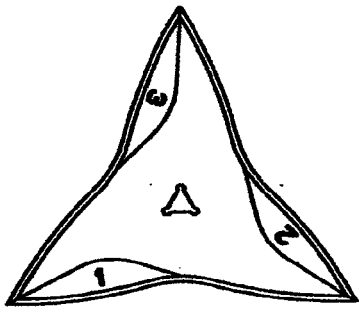
FIG. 21L is an elevational view of yet another alternative blade.
Figure 21M:
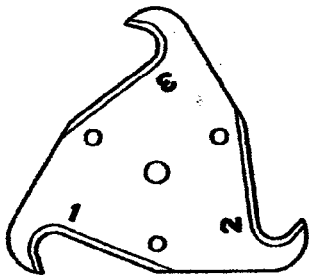
FIG. 21M is an elevational view of yet another alternative blade.
Figure 21N:
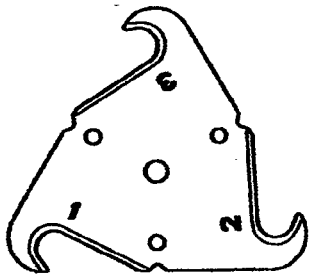
FIG. 21N is an elevational view of yet another alternative blade.

It should be noted that many blade types could be used in this embodiment or in many of the previous embodiments. FIGS. 21A-N demonstrate a wide variety of blades which may be used in combination with many of the knife embodiments disclosed herein.

It is to be understood that while certain aspects of the disclosed subject matter have been shown and described, the disclosed subject matter is not limited thereto and encompasses various other embodiments and aspects.

Having thus described the invention, what is claimed as new and desired to be secured by Letters Patent is:

1. A knife apparatus comprising:

a disposable blade having multiple cutting edges defining multiple cutting portions;

a housing including a handle portion comprising a first half and a second half, wherein said first half is joined to said second half by a plurality of mounting bolts;

said housing further including a blade receiver slot adapted for receiving said disposable knife blade such that only two of said multiple cutting portions are exposed from said housing;

said housing comprising a generally ergonomic shape;

said blade receiver slot located between said first half and said second half of said housing, wherein said first half includes a cut-away portion exposing said blade receiver slot;

wherein said disposable blade physically contacts said housing along more than one of the cutting edges of said blade, thereby restricting movement of said blade while within said housing;

a panel hingedly connected to said first half, said panel corresponding with said cut-way portion, such that said panel is adapted to be placed into one of: an open position and a closed position;

a lever connected to said panel, said lever located adjacent to said second half of said housing; and said hinge comprising a pivot point located within said housing.

2. The knife of claim 1, further comprising:

said second half of said housing including a recessed locking interface;

said lever including a sliding lock, said sliding lock adapted for engagement with said recessed locking interface; and wherein lifting said lever pivots said panel about said pivot point.

3. The knife apparatus of claim 1, wherein:

the blade is generally triangular with three corners, the multiple cutting edges is three cutting edges, and the multiple cutting portions is six cutting portions, wherein each of the corners is defined by a respective two of the six cutting portions.

4. The knife apparatus of claim 3, further comprising:

wherein four of the six cutting portions are at least partially covered by the housing; and two of the six cutting portions are at least partially exposed from said housing.

5. The knife apparatus of claim 4 further comprising:

wherein the two of the six cutting portions which are at least partially exposed respectively comprise a first exposed portion and a second exposed portion; and wherein said first exposed portion is engaged in a cutting motion.

* * * * *